US007014262B2

(12) United States Patent
Rossetto et al.

(10) Patent No.: US 7,014,262 B2
(45) Date of Patent: Mar. 21, 2006

(54) SUPPORT FOR TILTING OR SYNCHRONIZED CHAIRS

(75) Inventors: Marco Rossetto, Venezia-Trivignano (IT); Massimo Costaglia, Santa Giustina in Colle (IT); Silvio Maestri, Fidenza (IT)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/519,136

(22) PCT Filed: Jun. 11, 2003

(86) PCT No.: PCT/US03/18421

§ 371 (c)(1),
(2), (4) Date: Dec. 22, 2004

(87) PCT Pub. No.: WO04/000075

PCT Pub. Date: Dec. 31, 2003

(65) Prior Publication Data

US 2005/0236878 A1 Oct. 27, 2005

(30) Foreign Application Priority Data

Jun. 25, 2002 (IT) ..... CR2002A0012
Mar. 25, 2003 (IT) ..... CR20030004 U

(51) Int. Cl.
*A47C 1/032* (2006.01)

(52) U.S. Cl. ..... 297/300.8; 297/301.7; 297/303.4

(58) Field of Classification Search .. 297/300.4–300.8, 297/301.5–301.7, 302.7, 303.4
See application file for complete search history.

(56) References Cited

U.S. PATENT DOCUMENTS

| | | | | | |
|---|---|---|---|---|---|
| 4,384,741 | A * | 5/1983 | Flum et al. | ..... | 297/300.5 |
| 5,765,914 | A * | 6/1998 | Britain et al. | ..... | 297/300.4 |
| 5,971,481 | A * | 10/1999 | Emmenegger et al. | ... | 297/300.8 |
| 6,010,189 | A * | 1/2000 | Hybarger et al. | ..... | 297/300.8 |
| 6,033,020 | A * | 3/2000 | Ito | ..... | 297/302.4 |
| 6,450,577 | B1 * | 9/2002 | Roslund, Jr. | ..... | 297/301.7 |

* cited by examiner

*Primary Examiner*—Peter R. Brown
(74) *Attorney, Agent, or Firm*—Shook, Hardy & Bacon LLP

(57) ABSTRACT

A support for tilting or synchronized chair is provided. The device includes a supporting frame, a mobile frame, an elastic member, a stiffness adjustment mechanism coupled with the elastic member, a locking mechanism for engaging the mobile frame with the supporting frame, and an actuation device for engaging and disengaging the locking mechanism. The actuation device includes a rocker arm and a return arm. The return arm is connected to the end of the rocker arm that the locking mechanism is attached. The rocker arm has at least two positions of stable equilibrium that are determined by the engagement or disengagement of the locking mechanism. An alternative embodiment includes an outer shell having first and second pins that are coupled with the backrest frame. The second pin may be positioned within a slot formed in the shell so that the backrest frame may move between upright and reclined positions.

26 Claims, 9 Drawing Sheets

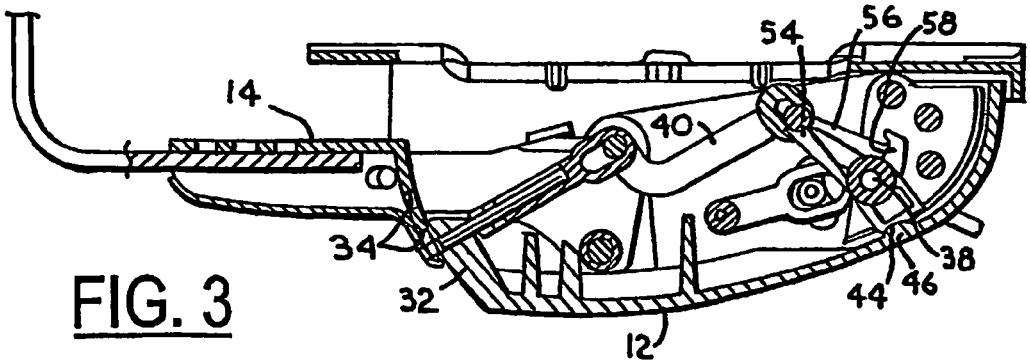
FIG. 3
FIG. 4
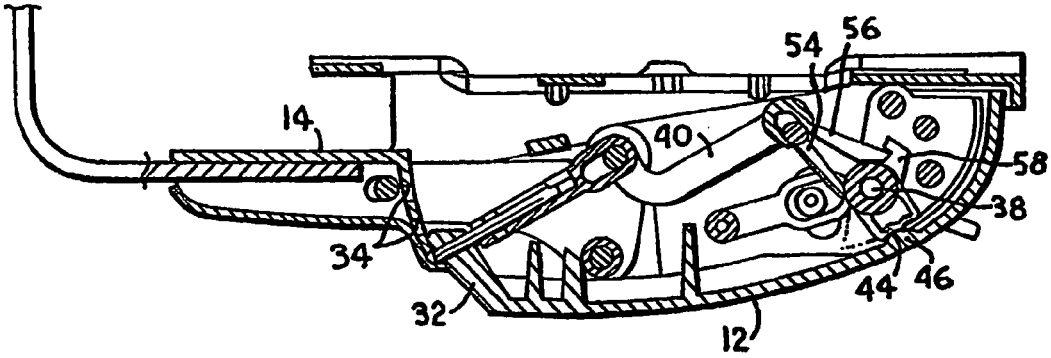
FIG. 5
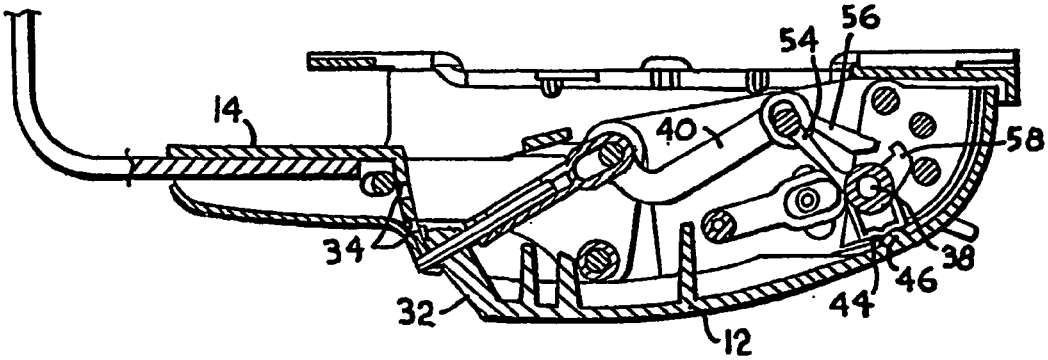

SUPPORT FOR TILTING OR SYNCHRONIZED CHAIRS

BACKGROUND OF THE INVENTION

The present invention relates to a support for tilting or synchronized chairs.

Supports for tilting chairs are well known in the art. In general, a chair support includes at least one supporting frame connected to the column of the chair, one mobile frame hinged onto the supporting frame in order to be able to tilt with respect to the support frame, a stiffness adjustment mechanism for the elastic return of the mobile frame that is activated by a knob, and one locking system. The locking system allows for the selective positioning of the mobile frame in a certain number of predetermined angular positions. The supports for tilting or synchronized chairs are also normally provided with a seat lifting and lowering system, basically comprising a gas piston controlled by a lever.

In known types of chair supports, the stiffness adjustment mechanism generally comprises a compression spring. The spring is pivotally connected to the mobile frame and is attached to the supporting frame through a moving support, which permits the spring to be pre-loaded in order to adjust the stiffness.

On the basis of the known technique, the moving spring support basically includes es two elements. A first element slides along a pin, to which it is attached with a screw-internal thread fit, and rests on a locator surface. The pin is one with the user activated stiffness adjustment knob. A second element comprises a flat surface on which the actual spring comes to rest. The two elements are in contact with each other on flat surfaces that are inclined in relation to the spring axis. When the user turns the adjusting knob, the first element moves in the axial direction of the pin, along the locator surface, due to the effect of the screw-internal thread fit. The thrust between the inclined surfaces causes the second element to move in the direction of the spring axis thereby increasing or decreasing the compression of the actual spring depending on the direction of rotation of the knob. The relationship between the two elements described above creates a sliding block type constraint in the axial direction of the actual spring.

The locking system of the mobile frame includes a locking mechanism attached to the supporting frame and the mobile frame respectively, designed for a mutual locking or engaging of the pin-hole, plate-groove or equivalent type. A known system, for example, consists of fixing a notched rod to one of the two frames and a holding element to the other frame, designed to selectively engage with the notched rod in order to stop its movement. Another system consists of using a clutch system, in which two plates are fixed to the supporting frame and to the mobile frame, and are coupled together and held under pressure by elastic means or screw-internal thread systems. Yet another system may include the use of spring pins attached to the supporting frame, capable of selectively engaging holes located on the mobile frame.

The locking system may also comprise a device designed to permit the user to engage and disengage the locking system by acting on a control lever that has a lock position and a release position. The lever is generally attached to an engagement mechanism that makes it stable in the locking and release positions in order to avoid accidental activation. If the mobile frame supports the chair back, for example, when the lever is in the locking position, the backrest is fixed at a certain inclination, while when the lever is in the release position, the backrest may be freely tilted in relation to the seat.

However, the locking mechanism may only be engaged if the mobile frame is aligned with one of the predetermined locking positions on the supporting frame. For example, in the case of a pin-hole fit, it is clear that the locking is only possible for those positions of the mobile frame in relation to the supporting frame in which the pin and the hole are precisely aligned. Therefore, if the control lever is directly and rigidly connected to the locking mechanism, it may only move into the locking position if the position of the mobile frame permits the engagement with the locking mechanism. Otherwise the user notices a bothersome resistance on the lever and cannot manage to put it in the locking position.

There are also problems associated with prior art chair supports. For instance, when the user releases the backrest, it tends to return abruptly to the rest position under the thrust of the return spring and sometimes hitting the back of the user.

To avoid these drawbacks, supports for tilting chairs are equipped with an engagement and disengagement device that comprises a mechanism of automatic search for the locking position and a non-return mechanism designed to prevent the abrupt return of the backrest immediately after the release. The automatic search mechanism permits the user to move the lever to the locking position regardless of the inclination of the backrest, or the position of the mobile frame in relation to the supporting frame, and thereafter activates the locking mechanism as soon as the backrest reaches one of the predetermined locking positions.

The non-return mechanism permits the disengagement of the locking mechanism only when the user, after having moved the lever to the release position, leans against the backrest and balances the thrust of the return spring. Both the automatic lock search and the non-return mechanisms must therefore let the engagement and disengagement device release at a later moment in relation to that in which the user moves the control lever from one to another position. These mechanisms, according to the known state of the art, are substantially fabricated through a plurality of moving elements attached to springs that are loaded when the user moves the control lever, and therefore permit the automatic activation, in a subsequent moment, of the actual mechanisms.

In known types of supports for tilting or synchronized chairs, the engagement and disengagement device therefore includes at least one spring for the automatic search of the locking position, one non-return spring, and if necessary also a third spring that permits the stability of the control lever in the locking and release positions.

These particular supports for tilting or synchronized chairs present certain shortcomings and drawbacks. For example, the engagement and disengagement device of the locking means of the mobile frame is somewhat complicated and expensive due to the presence of various moving elements joined together and the use of at least two or three springs. Due to the high number of components, the device is somewhat laborious to assemble and may be subject to malfunctioning over a period of time.

Furthermore, the stiffness adjustment mechanism for adjusting the stiffness of the return of the mobile frame, fabricated according to the known technique, presents certain drawbacks. In particular, when the mobile frame tilts, the return spring, which has one end pivotally connected to the mobile frame, and the other end attached to the supporting frame with a sliding block type of constraint, flexes in relation to its axis. The spring does not therefore work solely by compression in axis, but is also stressed by flexural forces. This fact decreases the fatigue life of the actual spring and makes the mechanism less reliable over a period of time. It is theoretically possible to oversize the spring to compensate for the fact that it is stressed out of axis, but this may lead to problems of excessive return force and of overall dimensions since the available space is very limited.

Another drawback of the known type supports for tilting or synchronized chairs is the fact that they comprise three separate control and adjustment devices to control the seat gas lift and lowering system, to lock the backrest and to adjust the stiffness of the return spring respectively. However, the presence of many control devices may confuse the user. Furthermore, the presence of levers or knobs that protrude from the supporting frame are a disadvantage from an aesthetic point of view.

Accordingly, there exists a need for a support for tilting or synchronized chairs that ameliorates the aforementioned drawbacks and deficiencies. The present invention fills these needs as well as other needs.

BRIEF SUMMARY OF THE INVENTION

In order to overcome the above stated problems and limitations there is provided a support for tilting or synchronized chairs, including a device for the engagement and disengagement of the backrest lock, of particularly simple fabrication, formed by a reduced number of components, while allowing both the automatic search of the locking position and the non-return function. In particular, the present invention provides a support for tilting or synchronized chairs in which the backrest return spring is solely stressed by compression and not by flexure which increases the durability and reliability of the mechanism. In addition, the present invention provides a reduced number of control levers in order to make use more ergonomic and also to improve the aesthetic aspect of the chair fitted with the actual support.

In general, the support device of the present invention includes a supporting frame, at least one mobile frame coupled with the supporting frame, an elastic member coupled with the mobile frame and the supporting frame, a stiffness adjustment mechanism coupled with the elastic member, a locking mechanism for engaging the mobile frame with the supporting frame, and an actuation device for engaging and disengaging the locking mechanism.

The actuation device may be selectively activated by a control knob, wherein the actuation device includes a rocker arm coupled with the control knob that swings around a fulcrum, and a return arm that is generally rigid and non-deformable. The return arm is connected to the end of the rocker arm to which the locking mechanism is attached. The rocker arm has at least two positions of stable equilibrium that are determined by the engagement or disengagement of the locking mechanism. Further, the rocker arm comprises a lever arm positioned between the fulcrum and the return arm, the rocker arm is adapted to undergo elastic deformation due to the effect of an operation of the control knob, which moves the rocker arm between the positions of stable equilibrium, and whenever during the operation of the device there are opposing forces on the locking mechanism that prevent the movement of the return arm, the accumulation of the elastic deformation energy in the rocker arm moves the return arm upon the decrease of the opposing forces.

An alternative embodiment of the present invention includes an outer shell, an elastic member, a stiffness adjustment mechanism, a locking mechanism, an actuation device, and first and second pins. The outer shell has a front portion and at least one guide or slot associated therewith where the front portion of the outer shell is coupled with the seat. The elastic member is coupled with the outer shell and the stiffness adjustment mechanism is coupled with the elastic member. The locking mechanism is used for engaging the outer shell with the backrest frame. The actuation device engages and disengages the locking mechanism, and the actuation device may be selectively activated by a control knob. The actuation device includes a rocker arm coupled with the control knob that swings around a fulcrum, and a return arm that is generally rigid and non-deformable. The return arm is connected to the end of the rocker arm to which the locking mechanism is attached. The rocker arm has at least two positions of stable equilibrium that are determined by the engagement or disengagement of the locking mechanism. The rocker arm comprises a lever arm positioned between the fulcrum and the return arm. The rocker arm is adapted to undergo elastic deformation due to the effect of an operation of the control knob, which moves the rocker arm between the positions of stable equilibrium. In operation, there are opposing forces on the locking mechanism that prevent the movement of the return arm. The accumulation of the elastic deformation energy in the rocker arm moves the return arm upon the decrease of the opposing forces.

The first pin is associated with the return arm and is coupled with the outer shell. In addition, the first pin is coupled with the backrest frame. The second pin is coupled with the elastic member and positioned within the guide formed in the outer shell. A portion of the second pin is coupled with the backrest frame and the backrest frame is coupled with the seat. The seat and backrest frame may move between positions as the backrest frame rotates about the first pin and as the second pin slides within the guide formed in the shell.

Additional objects, advantages and novel features of the present invention will be set forth in part in the description which follows, and will in part become apparent to those in the practice of the invention, when considered with the attached figures.

BRIEF DESCRIPTION OF THE SEVERAL VIEWS OF THE DRAWINGS

The accompanying drawings form a part of this specification and are to be read in conjunction therewith, wherein like reference numerals are employed to indicate like parts in the various views, and wherein:

FIG. 3 is a longitudinal cross-sectional view of the support in FIG. 1 showing the locking system control in the locking position, where the position of the mobile frame is such that the mutual engagement of the locking mechanism of the backrest is not possible;

FIG. 4 is a longitudinal cross-sectional view of the support in FIG. 1 showing the locking system control in the locking position and the mobile frame locked, the relative locking mechanism being engaged;

FIG. 5 is a longitudinal cross-sectional view of the support in FIG. 1 showing the locking system control in the release position, but the locking mechanism is kept mutually engaged by forces of friction caused by the elastic return mechanism that is attached to the mobile frame;

DETAILED DESCRIPTION OF THE INVENTION

Figure 1:
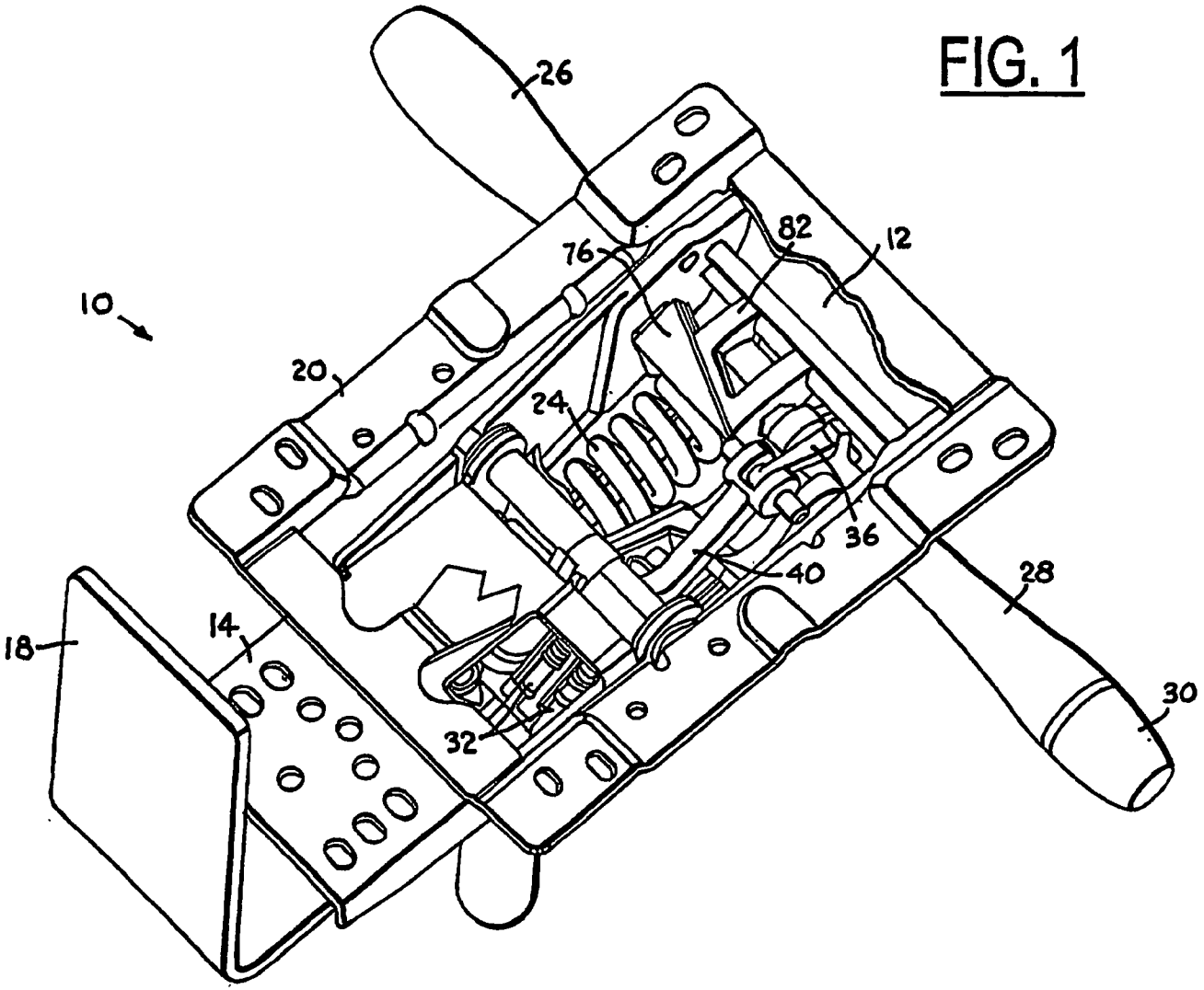
FIG. 1 is a top perspective view of a support for tilting and synchronized chairs according to the present invention with parts broken away to make the internal mechanisms visible.

Referring now to the drawings in detail, and initially to FIG. 1, reference numeral 10 generally designates a device for tilting or synchronized chairs constructed in accordance with the present invention. Device 10 general includes a supporting frame 12 and a mobile frame 14. Supporting frame 12 is connected to a column 16 that extends downwardly toward a support surface. A plate 18 designed to support the backrest of the chair and is fixedly coupled with the mobile frame 14. With additional reference to FIG. 2, support 10 is synchronized and also includes a frame 20 to provide a mounting location for the seat.

Figure 2:
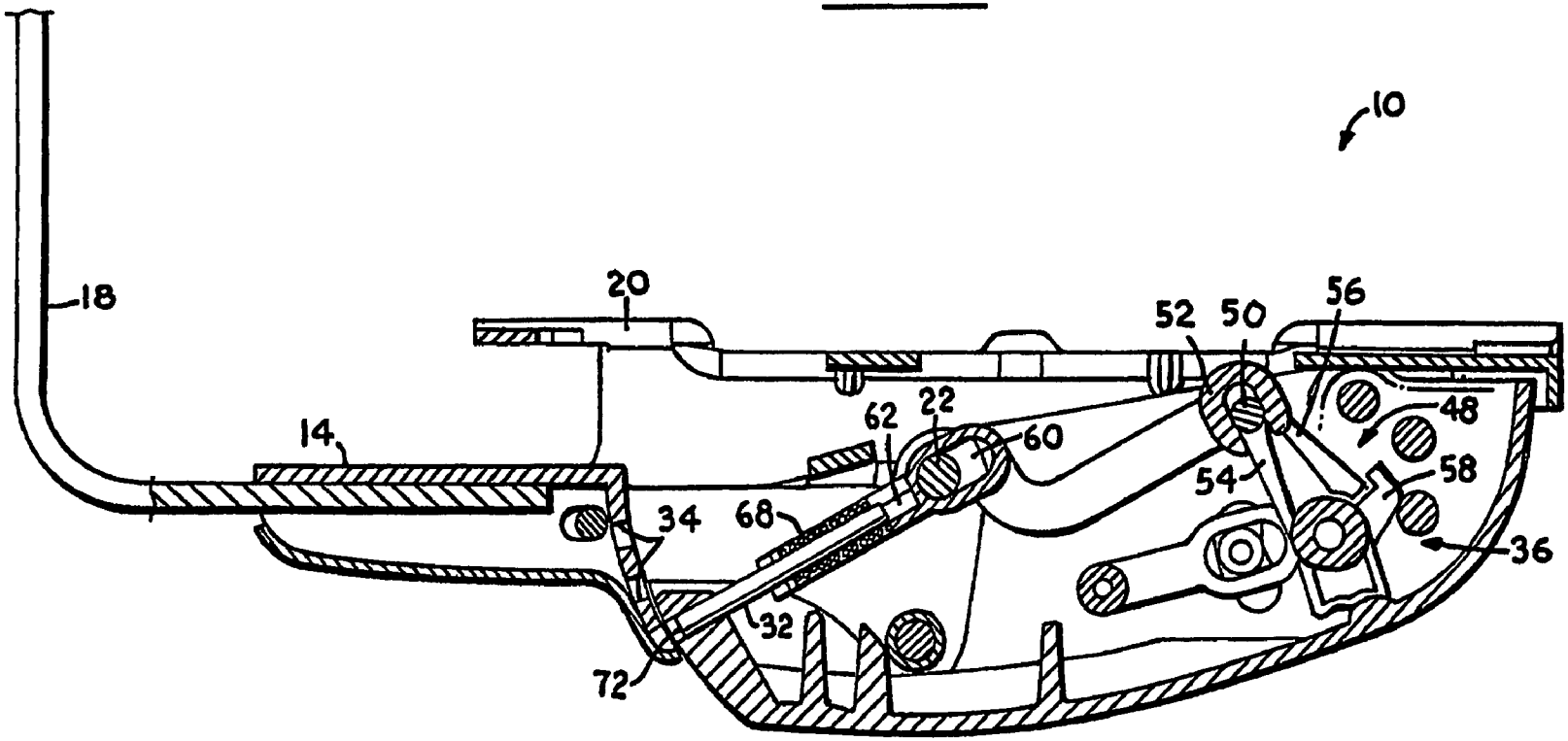
FIG. 2 is a longitudinal cross-sectional view of the support in FIG. 1 showing the locking system control in the release position, with the mobile frame free to tilt.
Figure 6:
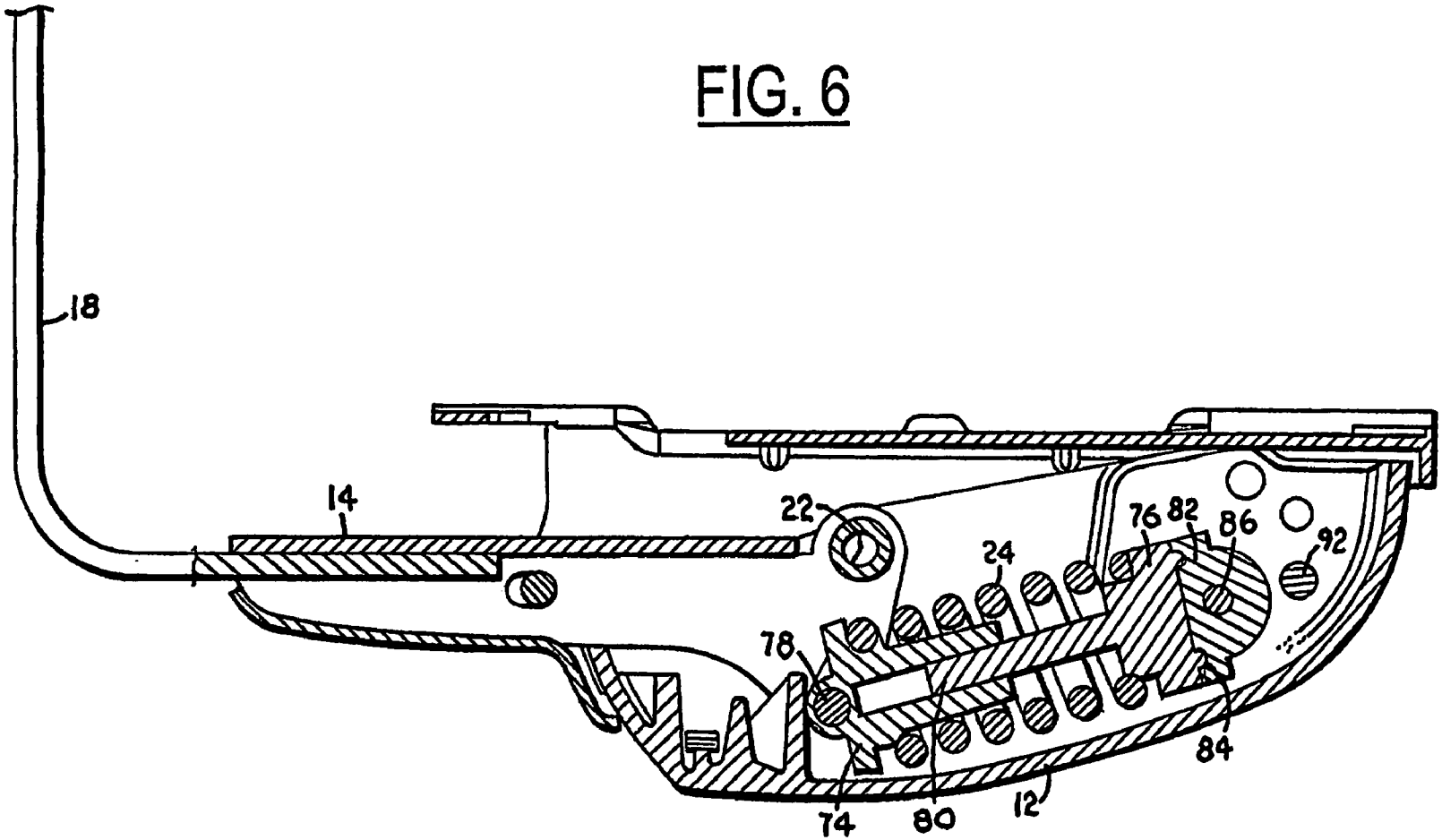
FIG. 6 is a longitudinal cross-sectional view of the support in FIG. 1 taken along a plane parallel to the section plane of the FIGS. 2–5.
Figure 10:
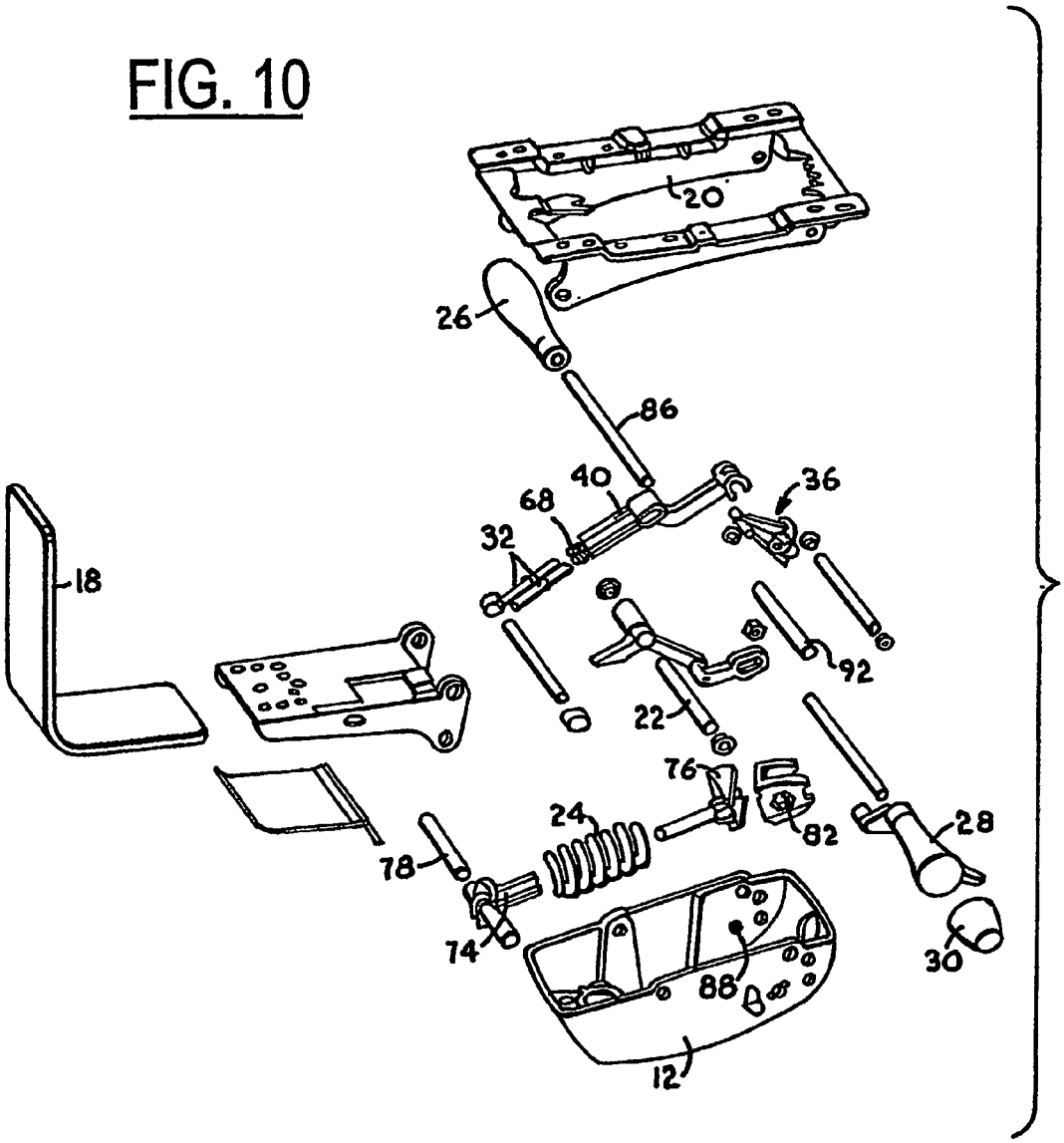
FIG. 10 is an exploded view of the support in FIG. 1.

As best seen in FIGS. 2 and 6, mobile frame 14 is attached to supporting frame 12 by a pin 22, which allows mobile frame 14 to tilt in relation to supporting frame 12. A spring 24 acts as elastic return element of mobile frame 14. In addition, as best seen in FIGS. 1 and 10, support 10 includes a stiffness adjustment mechanism for spring 24, which will be described in more detail below, that is attached to an adjusting lever 26, and a seat lifting and lowering system, with gas piston, controlled by a lever 28.

Support 10 also includes a locking system, designed to permit the user to lock the back of the chair in an angular position that may be selected from a predetermined number of locking positions. The locking system operates to oppose the return force of the spring 24. The locking system basically comprises a locking mechanism, attached to supporting frame 12 and to mobile frame 14, and an actuation device for engaging and disengaging the locking mechanism. The actuating device may be activated by the user using a relative control device that has at least one locking and one release position. As shown in FIG. 1, the control device includes a wheel or knob 30 that is attached to lever 28, forming the rotating end of the actual lever.

The locking mechanism includes at least one pin 32 which is attached to supporting frame 12, designed to engage in at least one hole 34 in mobile frame 14. Preferably, there are two pins 32 side by side, and mobile frame 14 that includes a plurality of holes 34 arranged along two staggered rows to increase the number of selectable locking positions.

As best seen in FIGS. 2–6, the actuating device that allows for engagement and disengagement includes a rocker arm 36 that is pivotably mounted with a pin 38, which activates a return arm 40. Further, return arm 40 is coupled with the locking mechanism and the mobile frame 14.

The engagement mechanism is attached to supporting frame 12 and to rocker arm 36 and is adapted to determine at least two positions of stable equilibrium of rocker arm 36, which allows rocker arm 36 to rotate around pin 38 solely between the aforementioned positions. With reference to FIGS. 1 and 2, return arm 40 is attached to knob 30 through a coaxial return inside lever 28. Upon turning knob 30, rocker arm 36 rotates, and the two positions of stable equilibrium of rocker arm 36 correspond to the locking and release positions of knob 30. In a preferred embodiment of the engagement mechanism, rocker arm 36 comprises an arm 42 with a double-recess shaping 44, and supporting frame 12 includes a protrusion 46, designed to cooperate with recess 44 to forming a slip fit. Rocker arm 36 includes a lever arm 48, which connects to return arm 40 through a pin 50. Pin 50 is slidably coupled-within a slotted eye 52 of return arm 40. Pin 50 is coupled with the end of lever arm 48 of rocker arm 36, and slotted eye 52 is open at the bottom to permit insertion of pin 50.

Lever arm 48 is capable of deforming in order to permit the device to store elastic energy. The elastic deformation of lever arm 48 allows a non-return effect to be achieved. Furthermore, to achieve the automatic lock search, lever arm 48 acts rigidly and an elastic member is inserted between return arm 40 and the locking mechanism. In particular, lever arm 48 comprises a first shank 54 and a second shank 56. Second shank 56 is not rejoined to the body of the rocker arm 36, but has one end free, which may rest on a protruding tooth 58 of the actual rocker arm. Therefore it will be understood that lever arm 48 has a different flexural strength in both directions of rotation of rocker arm 36 around pin 38. Second shank 56 opposes flexure only if the flexure tends to compress it against tooth 58. The reverse is also the case, due to the discontinuity that distinguishes it, it makes no contribution to the flexural strength of lever arm 48.

Figure 9:
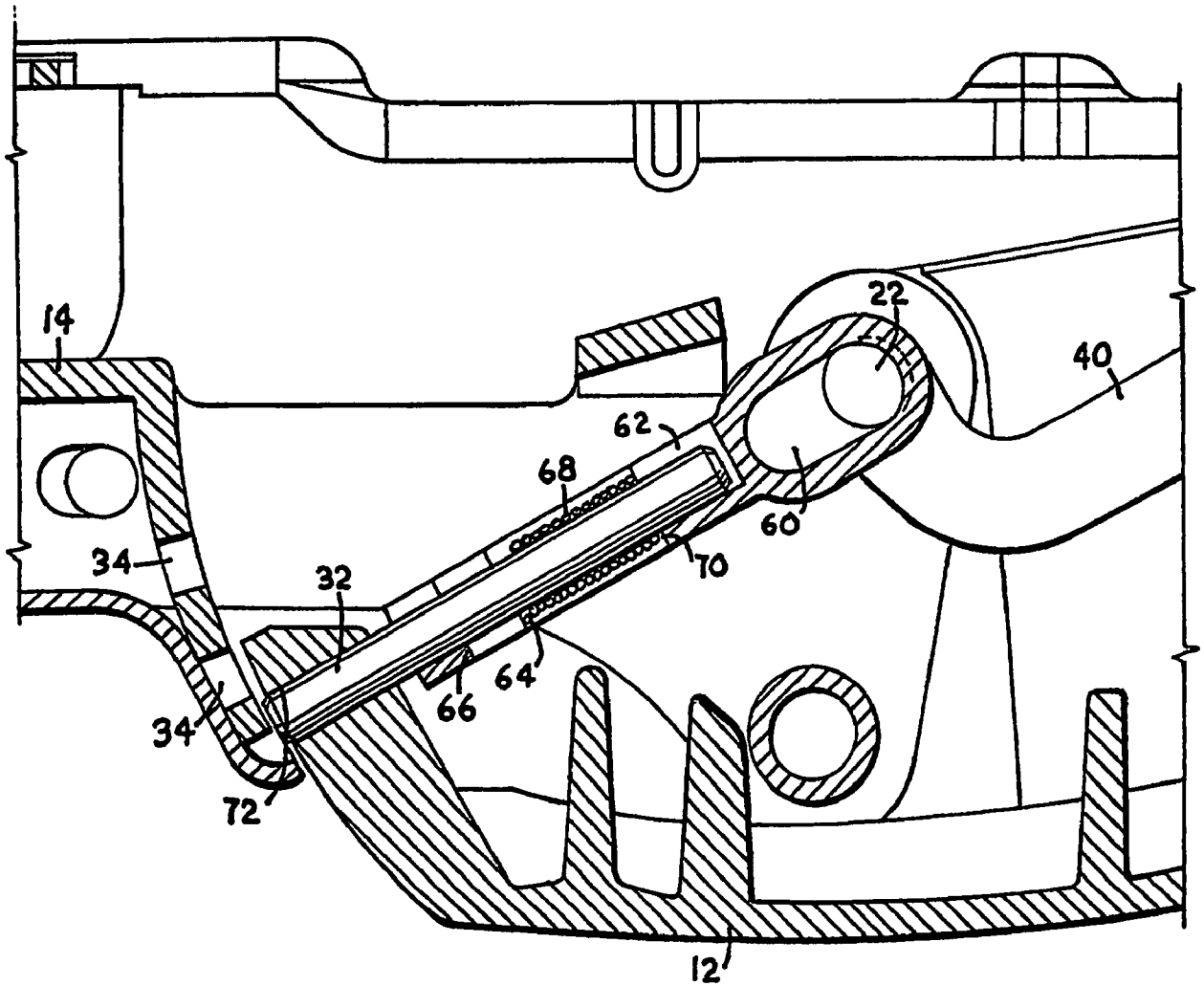
FIG. 9 is an enlarged detailed view of a portion of the support shown in FIG. 3.

As best seen in FIG. 9, return arm 40 comprises a slot 60 adapted to allow pin 22 to be inserted therein. Return arm 40 also comprises housings 62, in which pins 32 are slidably coupled therein. Pins 32 have a collar 64 that is adapted to stop against a ring-like protrusion 66 of housings 62. The elastic element inserted between return arm 40, and each pin 32 is represented by a thrust spring 68, external and coaxial to pin 32, which rests against collar 64 and against a thrust rim 70. Rim 70 is integrally formed with return arm 40. The end of each pin 32 is inserted in a hole 72 in the supporting frame 12. Return arm 40 is guided to move in a direction that coincides with the axis of the same pins 32 due to the effect of pin 22, which can slide in slot 60. Pins 32 are then inserted within holes 72.

The stiffness adjustment mechanism for the return spring 24 is best seen in FIGS. 1, 6, 7, 8 and 10. Spring 24 is attached to mobile frame 14 and to supporting frame 12 by two elements 74, 76 supporting its ends. Element 74 is attached to mobile frame 14 through a pin 78. It will be understood that elements 74, 76 may also form an axial guide 80 for spring 24. Element 76 forms the moving support of spring 24 in relation to supporting frame 12 and has an inclined surface in relation to the axis of spring 24. Element 76 is kept under pressure by spring 24 against a cursor 82, which also has an inclined surface in relation to the axis of spring 24. The inclined surfaces of element 74 and cursor 82 are in contact with each other and also comprise a grooved guide coupling 84. Cursor 82 is attached to a control pin 86, which is connected to stiffness adjusting lever 26. Pin 86 is supported by the supporting frame through an oversized hole 88 (FIG. 10) that allows pin 86 to accomplish small movements in the plane perpendicular to its axis. There is a screw-internal thread fit between control pin 86 and cursor 82, so that a rotation of pin 86 causes a translation of cursor 82, according to the axis of the actual pin. In order to limit the overall dimensions, control pin 86 of cursor 82 is aligned with the pin 38. Cursor 82 rests in a swiveling way, through the use of a concave seat 90, against a locator pin 92, whose axis is parallel to control pin 86. Control pin 86 and locator pin 92 are generally perpendicular to the axis of spring 24.

In operation, as best seen in FIG. 2, support 10 is in the release position where the mobile frame 14 is free to tilt if pushed with sufficient force to compress the return spring 24. To lock the backrest, knob 30 is rotated to make rocker arm 36 rotate around pin 38 which acts as fulcrum. Due to the effect of the aforementioned constraints, return arm 40 traverses in a direction coinciding with the axis of pins 32. This movement of return arm 40 causes pins 32 to move downwardly through the corresponding holes 72. If at least one of holes 34 formed in mobile frame 14 is aligned with one of pins 32, the mechanism directly takes on the position shown in FIG. 4 where the movement of mobile frame 14 is locked. Instead, if none of holes 34 is aligned with pins 32, where pins 32 are prevented from traversing by the contact with mobile frame 14, the movement of return arm 40 has the effect of compressing springs 68 that are coaxial to pins 32, between rim 70 and collar 64.

When the knob 30 reaches the locking position, the mechanism is in the configuration shown in FIG. 3. This position is stable due to the engagement mechanism attached to rocker arm 36, which keep springs 68 compressed. Starting from the configuration of FIG. 3, as soon as one of holes 34 is aligned with pin 32, spring 68 that is coaxial to pin 32 causes the pin to exit from hole 72. Pin 32 consequently engages hole 34 that is aligned therewith and locks mobile frame 14.

When knob 30 is turned from the release position to the locking position, lever arm 48 of rocker arm 36, by pushing return arm 40, acts as a basically rigid element in a flexural sense. Both shanks 54, 56 oppose the flexure of lever arm 48, due to shank 56 resting against tooth 58.

Starting from the locking position of FIG. 4, when the user turns knob 30 to the release position, two situations are possible. If the user is leaning against the backrest so that the return force of spring 24 is balanced, the mechanism goes into the configuration of FIG. 2. Further, if the back of the chair does not have a force imposed thereon, considerable shear stress, caused by the return force of spring 24 on mobile frame 14, acts on pin 32, which locks mobile frame 14. The shear stress locks pin 32 due to friction within hole 34, and therefore holds return arm 40 fast, due to the contact that exists between collar 64 of pin 32 and protrusion 66 which is integrally formed with the body of return arm 40.

Turning the knob 30 to the release position has the effect of flexing lever arm 48 of rocker arm 36. In this case, lever arm 48 is easily deformed in an elastic way because only shank 54 opposes the bending, while the discontinuous shank 56 does not react. The mechanism therefore takes on the configuration of FIG. 5. The engagement mechanism between rocker arm 36 and supporting frame 12 compensate the elastic stress on shank 54 of the actual rocker arm, thereby keeping it deformed. The non-return effect is thus achieved since mobile frame 14 remains locked, despite knob 30 being in the release position. As soon as the user leans against the backrest, however, contrasting the force of spring 24, the shear stress on pin 32 is relieved and the elastic stress of shank 54 makes the mechanism return to the initial position of FIG. 2.

Figure 7:
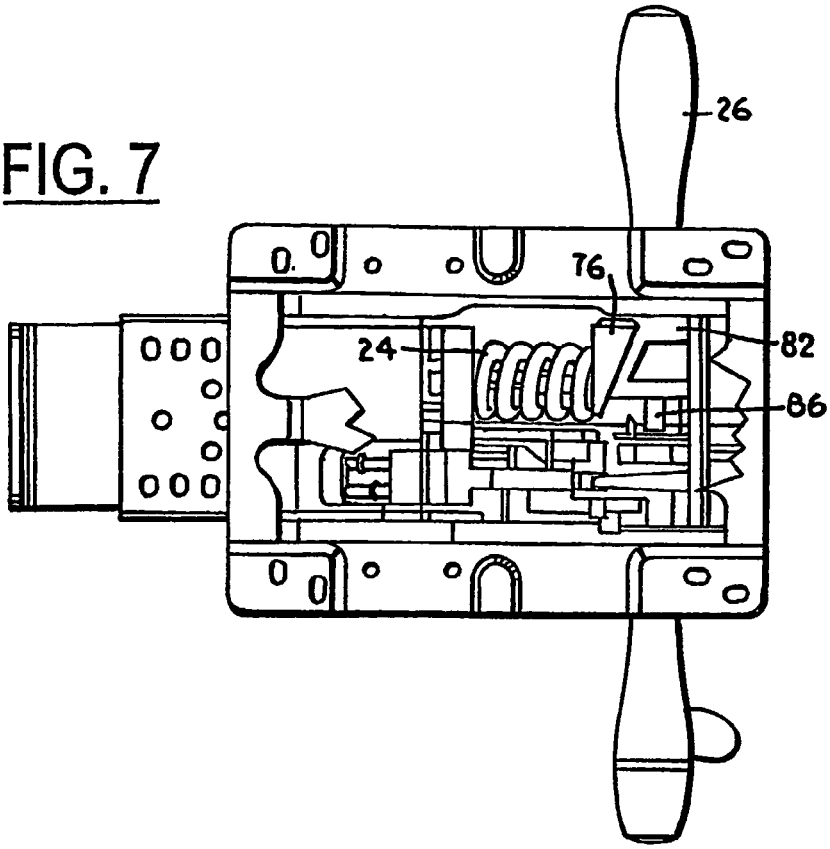
FIG. 7 is a plan view of the support in FIG. 1 showing the internal mechanisms adjusted to obtain the maximum stiffness of the backrest.
Figure 8:
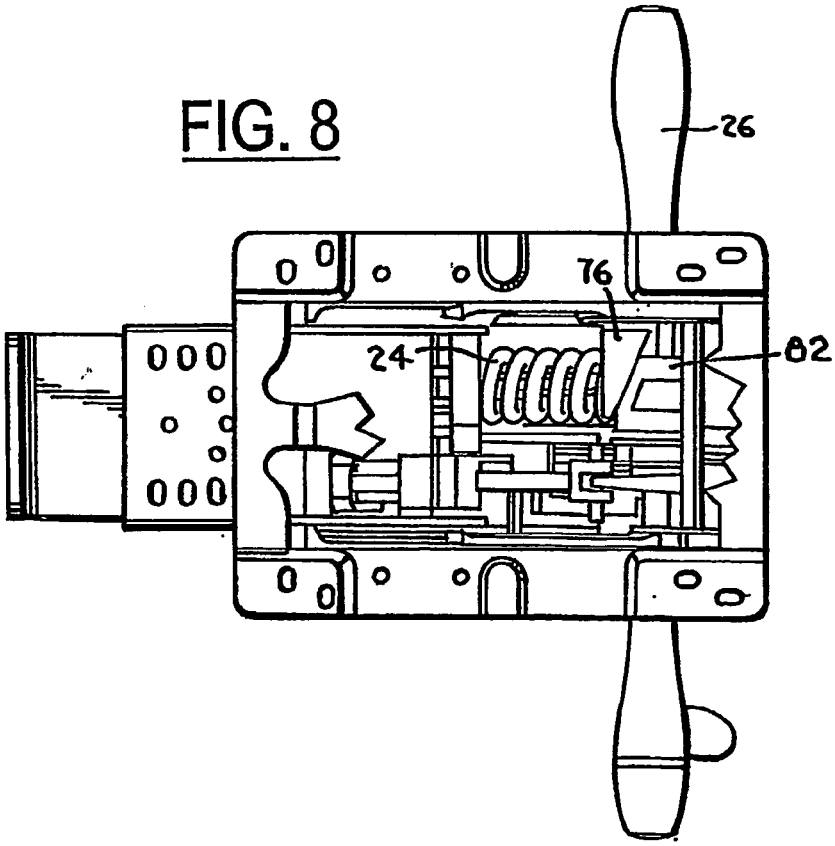
FIG. 8 is a plan view similar to FIG. 7 showing the internal mechanisms adjusted to obtain the minimum stiffness of the backrest.

Furthermore, as best seen in FIGS. 6–8, the operation of the stiffness adjustment mechanism for spring 24 may be initiated upon turning the lever 26. Thereafter, cursor 82 moves along control pin 86, due to the screw fit between cursor 82 and pin 86. Due to the contact between the inclined surfaces, the shifting of cursor 82 causes a shifting of the element 76 in the direction of the axis of spring 24, which pre-loads or releases the same spring and changes its stiffness, according to the direction of rotation of the lever 26. The support of cursor 82 on locator pin 92 creates a constraint that permits small inclinations of the moving support of spring 24, which is designed to keep spring 24 aligned in axis with the compressive force acting on it. Due to the movements of mobile frame 14, the clearance between pin 86 and hole 88 (FIG. 10) permits cursor 82 to tilt in relation to pin 92, in order to compensate the shifts of pin 78. The axes of pins 78, 86 and 92 continue to lie along a plane that comprises the axis of spring 24, spring 24 is therefore compressed solely by forces applied in the direction of its own axis. During use, the user may lift or lower the seat after having locked the backrest without changing control lever, thanks to the connection between the lever 28 and knob 30.

The present invention for a chair support overcomes or ameliorates the drawbacks and deficiencies in the prior art. Specifically, the rocker arm, which can be elastically deformed, permits the chair support to release at a later moment in relation to the activation of the control knob by the user, and therefore permits the non-return effect or the automatic lock search to be achieved without having recourse to springs or other elastic elements. In addition, the chair support may be fabricated with a limited number of simple components and therefore with limited costs. Another advantage of the present invention is that it permits a particularly long-term reliable support to be fabricated due to the constructional simplicity of the engagement and disengagement device of the locking mechanism. To improve the reliability of the support further, the stiffness adjusting mechanism includes a moving support capable of rotating in order to keep the return mechanism aligned with the axis of compressive stress, thereby eliminating flexural stress that could reduce their fatigue life. Yet another advantage of the present invention is that the engagement and disengagement device may be activated with a particularly limited force, which permits the locking and release control to be accomplished through a wheel or knob incorporated in the gas system control lever. The association between the seat lifting and lowering control and the backrest locking and release control reduces the number of controls that protrude from the supporting frame. This improves the ergonomics and ease of use, and also the aesthetic aspect of the actual support and of the chair on which it is mounted.

Figure 11:
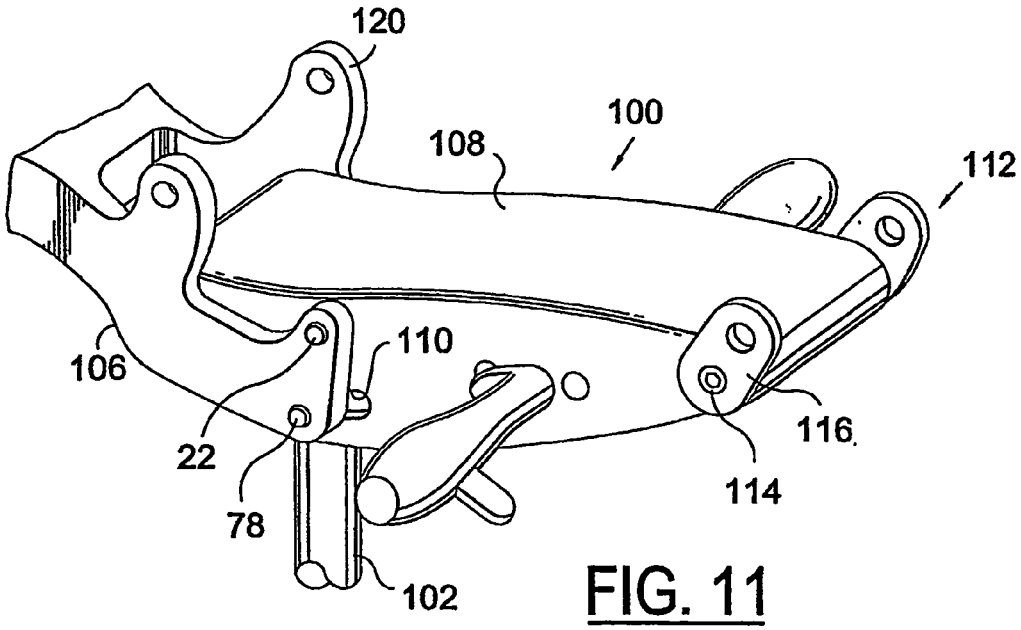
FIG. 11 is a perspective view of an alternative embodiment of the present invention mounted to a chair post and a backrest.
Figure 12:
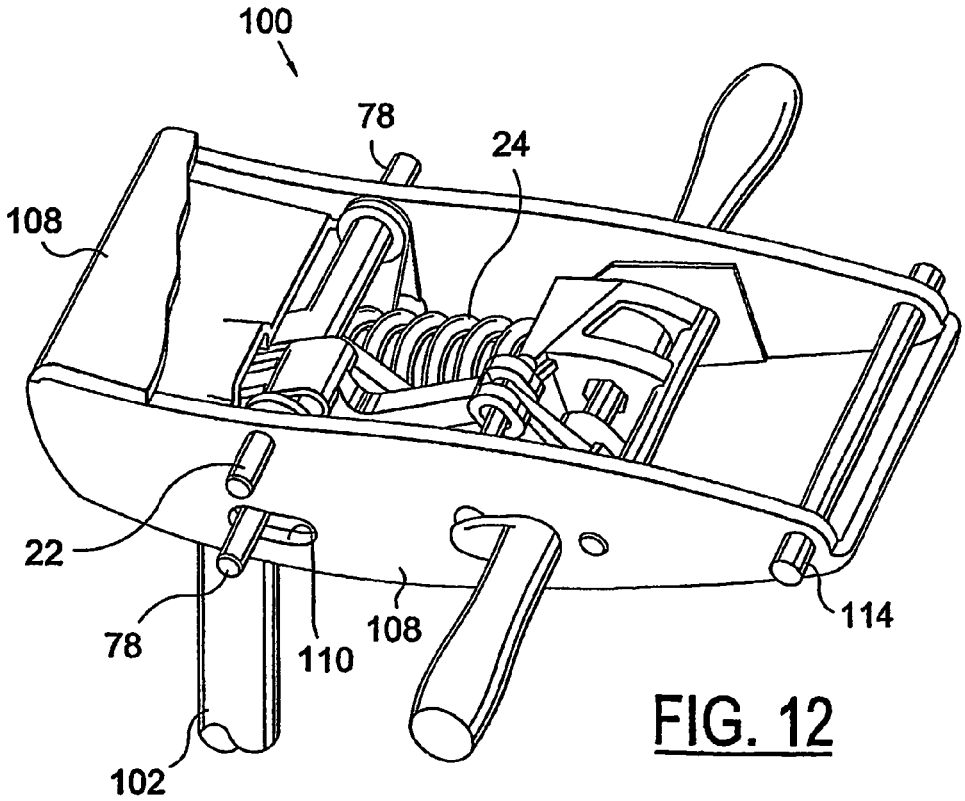
FIG. 12 is a perspective view similar to FIG. 11 with parts broken away showing the internal components of the present invention.
Figure 13:
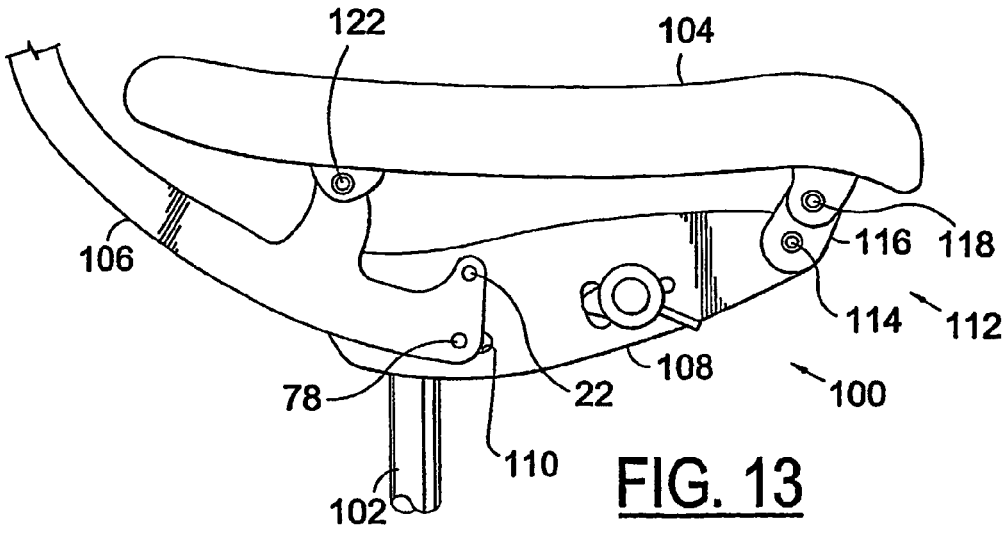
FIG. 13 is a side elevation view of the support in FIG. 11 with the backrest in an upright position.
Figure 14:
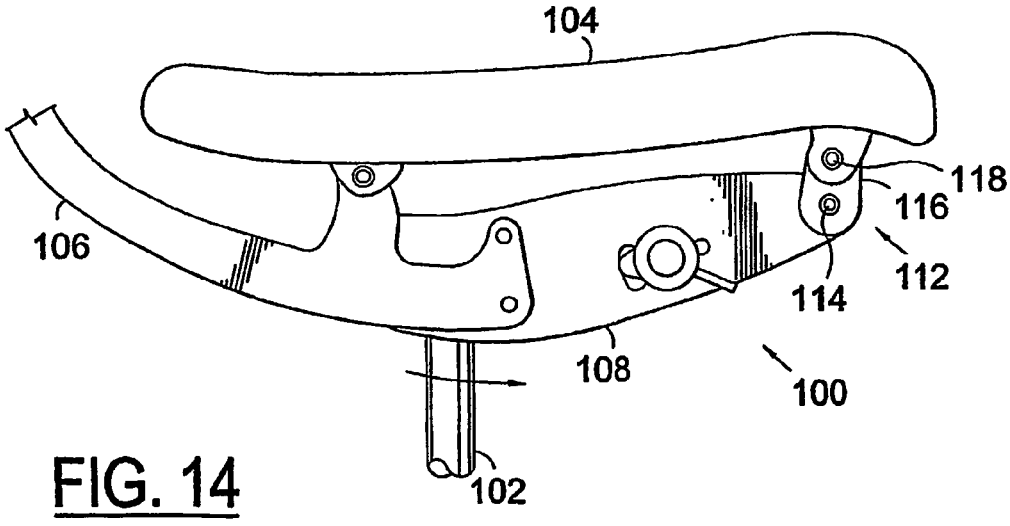
FIG. 14 is a side elevation view similar to FIG. 13 with the backrest in a reclined position.

The features and concepts set forth in the present invention may also be implemented in the form of an alternative support frame 100 as illustrated in FIGS. 11–14. As best seen in FIGS. 13 and 14, support frame 100 is coupled with a chair post 102, a seat 104 and a backrest frame 106. In particular, the front portion of seat 104 is coupled to a front portion of support, backrest frame 106 is coupled to a rear portion of support 100, and the rear portion of the seat is coupled with backrest frame 106. In general, support 100 allows seat 104 and backrest frame 106 to move between upright and reclined positions as best seen in FIGS. 13 and 14 respectively.

As best seen in FIGS. 11 and 12, support 100 includes an outer shell 108 that is configured to contain a substantial portion of the components that make up support 100. According to this embodiment of the present invention, a pair of slots 110 are defined in opposite sidewalls of shell 108 and are adapted to allow return pin 78 be slidably positioned therein. The size and shape of slots 110 will determine the length, path of movement, and end points of movement the backrest and seat will take when moving between upright and reclined positions. Furthermore, it will be understood that shell 108 need not have a slot formed therein so long as there is a similar type of guide structure that allows pin 78 to move along a predetermined path. In addition, pin 22 extends outwardly from opposite side surfaces of shell 108. It will be understood that pin 22 is generally stationary relative to shell 108 and allows backrest frame 106 to tilt between upright and reclined positions, while pin 78 is coupled with spring 24 to counter the pressure of the tilting movement.

As best seen in FIGS. 11 and 13, the front portion of support 100 may be coupled to the front portion of seat 104 by a hinge mechanism 112, which includes a pin 114 and a link 116. As best seen in FIG. 12, pin 114 extends between and may protrude from opposite sidewalls of the front portion of shell 108. Further, the portion of pin 114 that extends outward from shell 108 may be hingedly coupled with a pair of links 116 as best seen in FIG. 11. With additional reference to FIG. 13, link 116 may then be coupled with a pin 118, which is in turn coupled with the front portion of seat 104.

As best seen in FIG. 13, backrest frame 106 supports the rear portion of seat 104 and provides support for a backrest. The front portion of backrest frame 106 pivots about pin 22 and is capable of translating a distance the corresponds to the distance pin 78 is permitted to move within slot 110. An intermediate portion of backrest frame 106 includes a protrusion 120 that may be used along with a pin 122 to support the rear portion of seat 104.

It will be understood and appreciated that support 100 may also comprise the stiffness adjustment mechanism, the locking mechanism, and height adjustment devices through levers 26, 28 as described above or those otherwise known in the art. It will be understood that the locking mechanism will operate to couple outer shell 108 with the backrest frame to prevent movement of backrest and seat relative to support 100.

The alternative embodiment of the present invention for a chair support provides additional advantages over the prior art. Specifically, during the construction and assembly stages, the alternative embodiment facilitates the fabrication of the same chair in different customized models, in particular due to the use of pins 22, 78, 114, which define easily usable lateral points of attachment on support 100 that are not constraining for the conformation of backrest frame 106 or seat 104. Further, backrest frame 106 may be formed in a single piece to eliminate the use of a bar or tube-like rigid support with maximum freedom of configuration in the choice of the form and materials. Moreover, the alternative embodiment is easy to use because the weight of the user, according to the tilt of the axis of links 116, passing through the centers of pins 114, 118 tends to make the mechanism move forward or backward thereby facilitating adjustment of support 100.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

We claim:

1. A device for tilting or synchronized chairs, comprising: a supporting frame; at least one mobile frame coupled with the supporting frame; an elastic member coupled with the mobile frame and the supporting frame; a stiffness adjustment mechanism coupled with the elastic member; a locking mechanism for engaging the mobile frame with the supporting frame; and an actuation device for engaging and disengaging the locking mechanism, wherein the actuation device may be selectively activated by a control knob, wherein the actuation device includes: a rocker arm coupled with the control knob that swings around a fulcrum; and a return arm that is generally rigid and non-deformable, the return arm is connected to the end of the rocker arm that the locking mechanism is attached; wherein the rocker arm has at least two positions of stable equilibrium that are determined by the engagement or disengagement of the locking mechanism; and wherein the rocker arm comprises a lever arm positioned between the fulcrum and the return arm, the rocker arm is adapted to undergo elastic deformation due to the effect of an operation of the control knob, which moves the rocker arm between the positions of stable equilibrium, and whenever during the operation of the device there are opposing forces on the locking mechanism that prevent the movement of the return arm, the accumulation of the elastic deformation energy in the rocker arm moves the return arm upon the decrease of the opposing forces.

2. The device of claim 1, wherein the lever arm includes a solution of continuity adapted to give to the lever arm a different flexural strength depending on the direction of rotation of the rocker arm.

3. The device of claim 2, wherein the lever arm includes a first shank and a second shank.

4. The device of claim 1, wherein the actuation device includes: a shaping associated with the rocker arm; and a protrusion associated with the supporting frame and adapted to cooperate to form a slip fit.

5. The device of claim 1, wherein an elastic element is inserted between the locking mechanism and the return arm.

6. The device of claim 1, wherein the locking mechanism includes at least one pin slidably coupled within in a housing formed in the return arm, wherein the pin is adapted to be positioned within a hole defined in the supporting frame, and wherein the pin is adapted to be selectively engaged within at least one hole defined in the mobile frame.

7. The device of claim 6, wherein the elastic member includes a spring that is external and coaxial to the pin, wherein the spring extends between a collar of the pin and a rim formed in the return arm.

8. The device of claim 1, wherein the elastic member includes at least one spring and a support element that is adapted to move along to the axis of the spring due to the effect of a contact by resting on inclined surfaces with a cursor, wherein the cursor is adapted to slide on a control pin, and resting in a swiveling way against a locator pin, parallel to the control pin.

9. The device of claim 8, wherein the control pin is supported by the supporting frame by an oversized hole adapted to allow small movements of the control pin in order to permit the cursor to tilt in relation to the locator pin.

10. The device of claim 1, wherein the control knob is coaxially attached to a lever, wherein the control knob permits the user a further control or adjusting action.

11. A device for tilting or synchronized chairs, comprising: a supporting frame; at least one mobile frame coupled with the supporting frame; means of elastic return coupled with the mobile frame and the supporting frame; stiffness adjustment means coupled with the means for elastic return; locking means for engaging the mobile frame with the supporting frame; and means for engaging and disengaging the locking mechanism that may be selectively activated by a control knob, wherein the actuation device includes: a rocker arm coupled with the control knob that swings around a fulcrum; and a return arm that is generally rigid and non-deformable, the return arm is connected to the end of the rocker arm that the locking means is attached; wherein the rocker arm has at least two positions of stable equilibrium that are determined by the engagement or disengagement of the locking means; and wherein the rocker arm comprises a lever arm positioned between the fulcrum and the return arm, the rocker arm is adapted to undergo elastic deformation due to the effect of an operation of the control knob, which moves the rocker arm between the positions of stable equilibrium, and whenever during the operation of the device there are opposing forces on the locking means that prevent the movement of the return arm, the accumulation of the elastic deformation energy in the rocker arm moves the return arm upon the decrease of the opposing forces.

12. The device of claim 11, wherein the lever arm includes a solution of continuity adapted to give to the lever arm a different flexural strength depending on the direction of rotation of the rocker arm.

13. The device of claim 12, wherein the lever arm includes a first continuous shank and a second interrupted shank.

14. The device of claim 11, wherein the means of engagement includes: a shaping associated with the rocker arm; and a protrusion associated with the supporting frame and adapted to cooperate to form a slip fit.

15. The device of claim 11, wherein an elastic element is inserted between the locking means and the return arm.

16. The device of claim 11, wherein the locking means includes at least one pin slidably coupled within in a housing formed in the return arm, wherein the pin is adapted to be positioned within a hole defined in the supporting frame, and wherein the pin is adapted to be selectively engaged within at least one hole defined in the mobile frame.

17. The device of claim 16, wherein the elastic member includes a spring that is external and coaxial to the pin, wherein the spring extends between a collar of the pin and a rim formed in the return arm.

18. The device of claim 11, wherein the means of elastic return includes at least one spring and a support element that is adapted to move along to the axis of the spring due to the effect of a contact by resting on inclined surfaces with a cursor, wherein the cursor is adapted to slide on a control pin, and resting in a swiveling way against a locator pin, parallel to the control pin.

19. The device of claim 18, wherein the control pin is supported by the supporting frame by an oversized hole adapted to allow small movements of the control pin in order to permit the cursor to tilt in relation to the locator pin.

20. The device of claim 11, wherein the control knob is coaxially attached to a lever, wherein the control knob permits the user a further control or adjusting action.

21. A device for tilting a seat and backrest frame between two or more positions, comprising: an outer shell having a front portion and at least one guide associated therewith, the front portion of the outer shell being coupled with the seat; an elastic member coupled with the outer shell; a stiffness adjustment mechanism coupled with the elastic member; a locking mechanism for engaging the outer shell with the backrest frame; and an actuation device for engaging and disengaging the locking mechanism, wherein the actuation device may be selectively activated by a control knob, wherein the actuation device includes: a rocker arm coupled with the control knob that swings around a fulcrum; and a return arm that is generally rigid and non-deformable, the return arm is connected to the end of the rocker arm that the locking mechanism is attached; wherein the rocker arm has at least two positions of stable equilibrium that are determined by the engagement or disengagement of the locking mechanism; and wherein the rocker arm comprises a lever arm positioned between the fulcrum and the return arm, the rocker arm is adapted to undergo elastic deformation due to the effect of an operation of the control knob, which moves the rocker arm between the positions of stable equilibrium, and whenever during the operation of the device there are opposing forces on the locking mechanism that prevent the movement of the return arm, the accumulation of the elastic deformation energy in the rocker arm moves the return arm upon the decrease of the opposing forces; a first pin associated with the return arm and being coupled with the outer shell, wherein the first pin is coupled with the backrest frame; and a second pin coupled with the elastic member and positioned within the guide formed in the outer shell, wherein the portion of the second pin is coupled with the backrest frame, wherein the backrest frame is coupled with the seat, and wherein the seat and backrest frame move between positions as the backrest frame rotates about the first pin and as the second pin slides within the guide formed in the shell.

22. The device of claim 21, wherein a hinge mechanism couples the front portion of the outer shell with the seat.

23. The device of claim 22, wherein the hinge mechanism includes a third pin and a link, wherein the third pin is coupled with the outer shell, and wherein the link is coupled with the third pin and the seat.

24. The device of claim 21, wherein the backrest frame provides support for a backrest.

25. The device of claim 21, wherein the backrest frame includes a protrusion that is coupled with the seat.

26. The device of claim 21, wherein the guide is a slot formed in the outer shell.

* * * * *